United States Patent [19]

McArthur

[11] Patent Number: 4,637,607

[45] Date of Patent: Jan. 20, 1987

[54] DRIVE UNIT FOR EXERCISING APPARATUS

[76] Inventor: James McArthur, 1760 Kingsway, Port Coquitlam, British Columbia, Canada, V3C 1S5

[21] Appl. No.: 701,929

[22] Filed: Feb. 15, 1985

[51] Int. Cl.[4] ..... A63B 21/22

[52] U.S. Cl. ..... 272/132; 272/129

[58] Field of Search ..... 272/72, 73, 67, 68, 272/131, 132, 129, 134, 901, DIG. 4; 128/25 R; 474/101, 136

[56] References Cited

U.S. PATENT DOCUMENTS

| | | | |
|---|---|---|---|
| 3,212,776 | 10/1965 | Bassler | 128/25 R |
| 3,874,659 | 4/1975 | Amaroni | 272/129 |
| 3,939,723 | 2/1976 | Helm | 474/136 X |
| 3,966,201 | 6/1976 | Mester | 272/72 |
| 4,082,267 | 4/1978 | Flavell | 272/129 X |

*Primary Examiner*—Richard J. Apley
*Assistant Examiner*—Robert W. Bahr
*Attorney, Agent, or Firm*—Fetherstonhaugh & Co.

[57] ABSTRACT

A drive unit for providing kinetic frictional resistance to an exercising apparatus which includes a sub-frame with a driving and driven element coupled to the sub-frame a motor coupled to the driving element for rotatably driving the latter. The driving and driven elements are coupled such that the driving and driven elements slip relative to one another. An adjustment is provided for adjusting the kinetic friction force between the driving and driven elements, while a stop is mounted on the sub-frame for blocking the driven element from movement beyond a start position. In operation the driving element is continuously driven by the motor throughout an exercise so that only kinetic friction has to be overcome by a user.

9 Claims, 5 Drawing Figures

DRIVE UNIT FOR EXERCISING APPARATUS

BACKGROUND OF THE INVENTION

The present invention relates to a drive unit for an exercising apparatus based on providing a friction resistance based on applied force.

The conventional method of providing resistance in an exercising apparatus is to use weights, flexible lines and pulley wheels. This type of apparatus has an inherent problem due to the inertia of the weights. In a typical exercise routine, because it is necessary to first accelerate the weight, force is required not only to lift the weight but also to accelerate it. Typically, once the weight has been initially accelerated, the user applied force is reduced significantly from its maximum, rising slightly towards the end of the exercise. Consequently, weight based exercising devices apply a relatively large force on the muscle over a relatively narrow range of movement in the exercise and a lesser force for the remainder of the movement.

Researchers have proposed a mechanical model of muscle to predict muscle tension based on input loading or stimulation which consists of a contractile component together with a linear series and parallel elastic component plus linear viscous damper. The damper serves to slow down frequency response of the muscle. The contractile component is considered to have an exponential response to a stimulus rising immediately to a maximum and then decreasing exponentially. The elastic components develop force in response to displacement or stretching of the muscle during which time they store potential energy. It is the elastic components which come into play once the contractile force has decreased significantly. Excitation of the elastic components is not considered as contributing significantly to muscle development whereas loading or stimulation of the contractile component is considered to be what stimulates strength gains. In an initial rapid acceleration of a weight, loading is first primarily on the contractile components of the muscles. However, after velocity has increased and acceleration has reduced sufficiently, loading on the contractile components reduces and the elastic components begin to predominate. The initial high loading and subsequent significant drop in loading characteristic of an inertial system further accentuates reduced loading of the contractile component over all but an initial portion of an exercise by reason of the delayed entry of the elastic component.

Much more effective loading results if the muscles of the user are loaded uniformly throughout the range of movement of the exercise so as to increase loading of the contractile components of the muscles.

One method of providing a uniform force substantially independent of acceleration is to utilize a resistance generation method that has a low mass such as one based on friction. U.S. Pat. No. 3,103,357 issued to Berne discloses an adjustable friction based exercising apparatus which utilizes an inner clutch disk sandwiched between outer disk members and in slipping contact with the latter. Hydraulic pressure is used to change the compression force on the central disk to vary the friction force between the disks.

Another method disclosed by U.S. Pat. No. 4,436,303 issued to McKillip utilizes a pair of disks held together in slipping contact by a corresponding pair of hydraulically operated pistons. The friction force required to make the disks slip over one another is adjusted by selecting the pressure applied by the pistons.

U.S. Pat. No. 3,953,025 issued to Mazman discloses a muscle building exercising device in which a pair of brake pads are pressed against each side of a disk.

Each of the foregoing devices disclose the utilization of friction in exercising apparatus to provide a concentric resistance force in which initially the slipping components are at rest. Since the force required to overcome static friction is larger than that required to overcome kinetic friction such devices impose a high threshold loading on the user and a lower load over the remainder of the range of movement of the exercise. Since it is user force which initiates slipping movement, the foregoing devices do not afford the user eccentric resistance in addition to concentric resistance.

SUMMARY OF THE INVENTION

According to the invention there is provided a drive unit for an exercising apparatus which includes a sub-frame, a driving element coupled to the sub-frame and a driven element also coupled to the sub-frame. Motor means are coupled to the driving element for rotatably driving the latter while coupling means couple the driving and driven elements such that the driving element and the drivene element slip relative to one another. Means are provided for adjusting the kinetic friction between the driving and driven elements. Stop means mounted on the sub-frame lock the driven element from movement beyond a start position except in a desired direction. The driving element is continuously driven by the motor means throughout an exercise. Providing for a motor driven driving element it is possible to apply continuous kinetic friction to the driven element during operation of the exercising apparatus. Such a method of operations allows one to utilize the driving unit for both concentric and eccentric exercises. In addition, because there is a continuous slipping in progress during operation of the unit, only kinetic friction is applied to the driven element by the driving element. Kinetic friction does not vary significantly with variations in the rate at which the slipping elements slip over one another. Thus, there is no starting friction to overcome when initiating an exercise as in previously known devices. By eliminating a high initial loading due to such factors as start-up friction or acceleration requirements of systems having a high inertial mass, a higher load may be placed on the muscles throughout the range of the exercise movement which loads the contractile components for a longer period of time.

Preferably the driving element and the driven element are driving and driven sheave wheels, respectively, rotatably mounted on the sub-frame and the coupling means is an endless belt linking the driving and driven sheave wheels.

The friction force adjusting means may include a slide way bar affixed to the sub-frame and a mounting block slidably coupled to the slide way bar for supporting the driving sheave wheel and movable in a direction so as to loosen or tighten the belt. Belt tensioning motor means may be affixed to the sub-frame and coupled to the mounting block being operable to reversibly move the block over the slide way bar. By driving the driving sheave wheel away from the driven sheave wheel greater tension is developed in the belt, thereby increasing the friction force applied to the driven sheave wheel.

The stop means may include sensing means to provide a control signal proportional to the force thereon applied by the drive sheave wheel. One can use this control signal to determine if an exercise has either started or ended or if the friction force is excessive.

Advantageously, an exercising member is removeably coupled to the driven sheave wheel and reversibly movable from the start position in response to an external user-applied force.

The member connecting means may include an elongated shaft coupled to the driven sheave wheel, gear means coupling the exercising member to the shaft and a shaft housing enclosing the shaft and coupled to the sub-frame. A gear casing encloses the gear means while a clutch assembly couples the gear casing to the shaft housing. The clutch assembly is manually operable to release and lock the casing against rotation with respect to the shaft housing. The gear means allows the exercising member to rotate about an axis oher than one which is aligned with the shaft. The clutch assembly permits the exercising member as well as the gear casing to rotate so as to allow it to be operable on the left and right sides of a user.

A frame may also be included which is pivotally coupled the sub-frame. Pivoting motor means coupled to the sub-frame and fixed with respect to the frame is operable to reversibly pivot the sub-frame with respect to the frame so as to adjust the elevation of the exercising member.

The pivoting motor means may include a motor pivotally mounted on base fixed relative to the frame, a threaded rod coupled to the motor and reversibly rotatably driven thereby and a block having a threaded receptacle registering with the threaded rod. The block may be pivotally coupled to the sub-frame such that upon rotation of the threaded rod, the block moves along the rod and thereby pivots the sub-frame with respect to the frame.

The clutch assembly means may include a cup having a wall with a frusttro-conical inner surface and a round hole through the wall. The cup may be axially aligned with and mounted over the shaft. A cone with a frustro-conical outer surface, mating with the frustro-conical inner surface of the cup is coupled to the gear casing. The cone may have a circumferential groove of rectangular cross-section on its outer surface. A cam having a large, round disk slidably, mating insertable into the hole of the cup wall together with a small round disk affixed to the large round disk but with its center off-set with respect to that of the large disk. The small disk is slidably insertable into the cone groove. A handle may be connected to the large disk for rotating the latter about the round hole in the cup wall such that a small disk engages the cone groove causing the cone to move away from contact with the cup. In this way, friction contact between the cone and the cup is released permitting the gear casing to be rotated relative to the shaft housing.

Preferably the driving pulley has a slip surface which has a low coefficient of friction with the belt while the driven pulley has a non-slip surface which has a high coefficient of friction with the belt. Preferably the sub-frame is pivotally coupled to the frame by means of pivotal connections affixed between the frame and the shaft housing. Although it is possible to pivotally couple the sub-frame in any convenient location with respect to the frame, it is desirable to affix it far enough away from the exercising member so as to permit reasonable adjustments of elevation upon pivoting of the sub-frame relative to the frame while at the same time locating the pivotal connection so that there is a reasonable balance between the loads on either side of the pivotal connections.

DETAILED DESCRIPTION WITH REFERENCE TO THE DRAWINGS

In the various Figures, like reference numbers refer to like parts.

Figure 1:
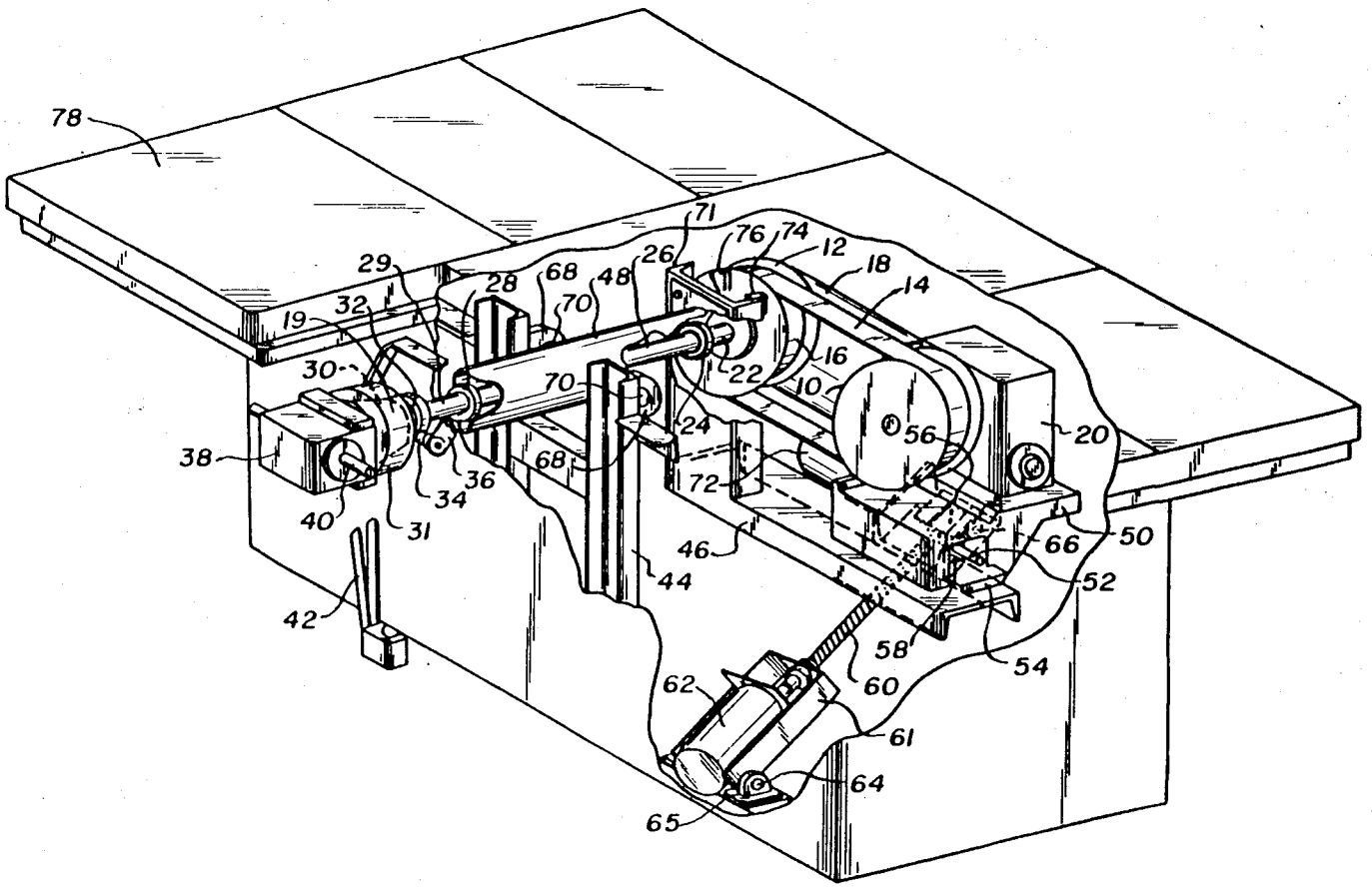
FIG. 1 is a perspective view of the drive unit incorporated into an exercising apparatus which is partly cut away to show details of the drive unit.

As shown in FIG. 1 a driven sheave wheel 10 is rotatably coupled to a gear box 20 driven by a motor 18. The gear box 20 provides a 30 to 1 gear reduction ratio.

Driving sheave wheel 10 is coupled by means of a flexible belt 14 to a driven sheave wheel 12. Sheave wheel 12 has a non-slip belt contacting surface while the corresponding belt contacting surface of driving sheave wheel 10 is a slip surface, having a low coefficient of friction with belt 14. A shaft 26 is coupled at 22 to driven sheave wheel 12 and supported by means of ball bearing 24 to shaft housing 48 ball bearing 28 support shaft 26 at 29. Shaft 26 passes through the center of a cone 30 into a gear housing 38.

Inside gear housing 38 shaft 29 translates its rotational motion to rotational motion of a transverse shaft 40 coupled to shaft 26 by a standard gear arrangement (not shown). Shaft 40 extends out both sides of gear housing 38. An exercising member 42 (shown partially cut away) is removably rigidly coupled to shaft 40.

Gear box 20 is supported on a mounting block 50 which in turn is slidably mounted on a slide way bar 54. Slide way bar 54 is affixed to a sub-frame element 46, shown more clearly in FIG. 2. A block 58 affixed in a channel section formed in the underside of block 50 has a threaded receptacle which registers with a threaded shaft 52 coupled to a tensioning motor 72. Tensioning motor 72 is mounted to sub-frame element 46. At the other end of sub-frame element 46 there is affixed a vertical sub-frame member 71 to which is rigidly coupled a shaft housing 48 enclosing intermediate shaft 26.

Figure 2:
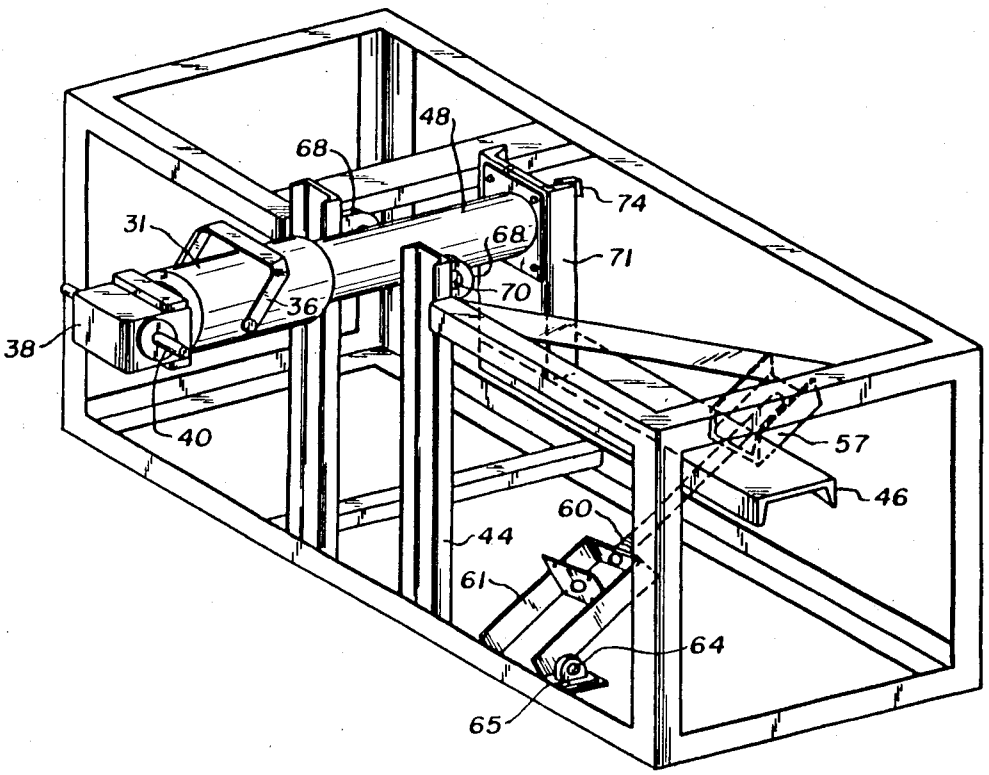
FIG. 2 is a perspective view showing the frame and sub-frame.

As shown in FIG. 2 shaft housing 48 is rigidly coupled to a cup 31 forming part of a clutch assembly which releasably connects to gear housing 38. Sheave wheel 12 rotates about a bearing affixed to vertical sub-frame element 71 and is coupled to driven shaft 26. (The latter bearing and its connection to vertical sub-frame element 71 is not shown.) Shaft housing 48 is pivotally attached by means of pins 70 journalled within bushings 68 affixed to main frame 44. A block 57, shown in FIG. 2, is affixed to sub-frame element 46 and has pivotally coupled thereto by means of pivot pins 66 a block 56 having a threaded receptacle for receiving a threaded shaft 60 registering therewith. Threaded shaft 60 in turn is coupled to a motor 62 mounted in a motor frame 61 which is pivotally connected by pins 64 to a base 65 fixed with respect to the main frame 44.

The load cell stop means 74 is coupled to the vertical sub-frame element 71 and is positioned so as to abut a protruding element 76 affixed to the flat face of sheave wheel 12. Upon contact of the element 76 with the load cell 74, an external control signal is provided which is proportional to the torque developed by sheave wheel 12. This control signal is available for use in determining whether an exercise has started or ended or whether the torque is excessive. The strain gage 19 is affixed to the shaft 26 to measure the force applied to exercising member 42. To main frame 44 there is affixed a padded upper surface 78 to accomodate a user.

Figure 4:
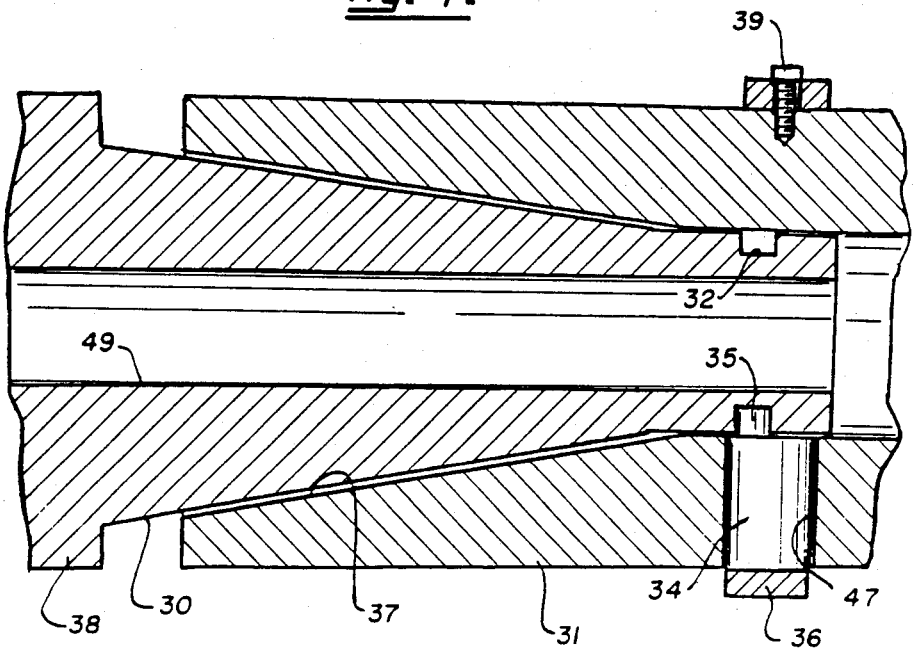
FIG. 4 is a sectional view of the clutch assembly.

The clutch assembly consisting of cup 31 (shown partially in FIG. 1), cone 30 having a cone groove 32 and a cam 34 coupled to a handle 36 is shown in more detail in FIG. 4.

Figure 3:
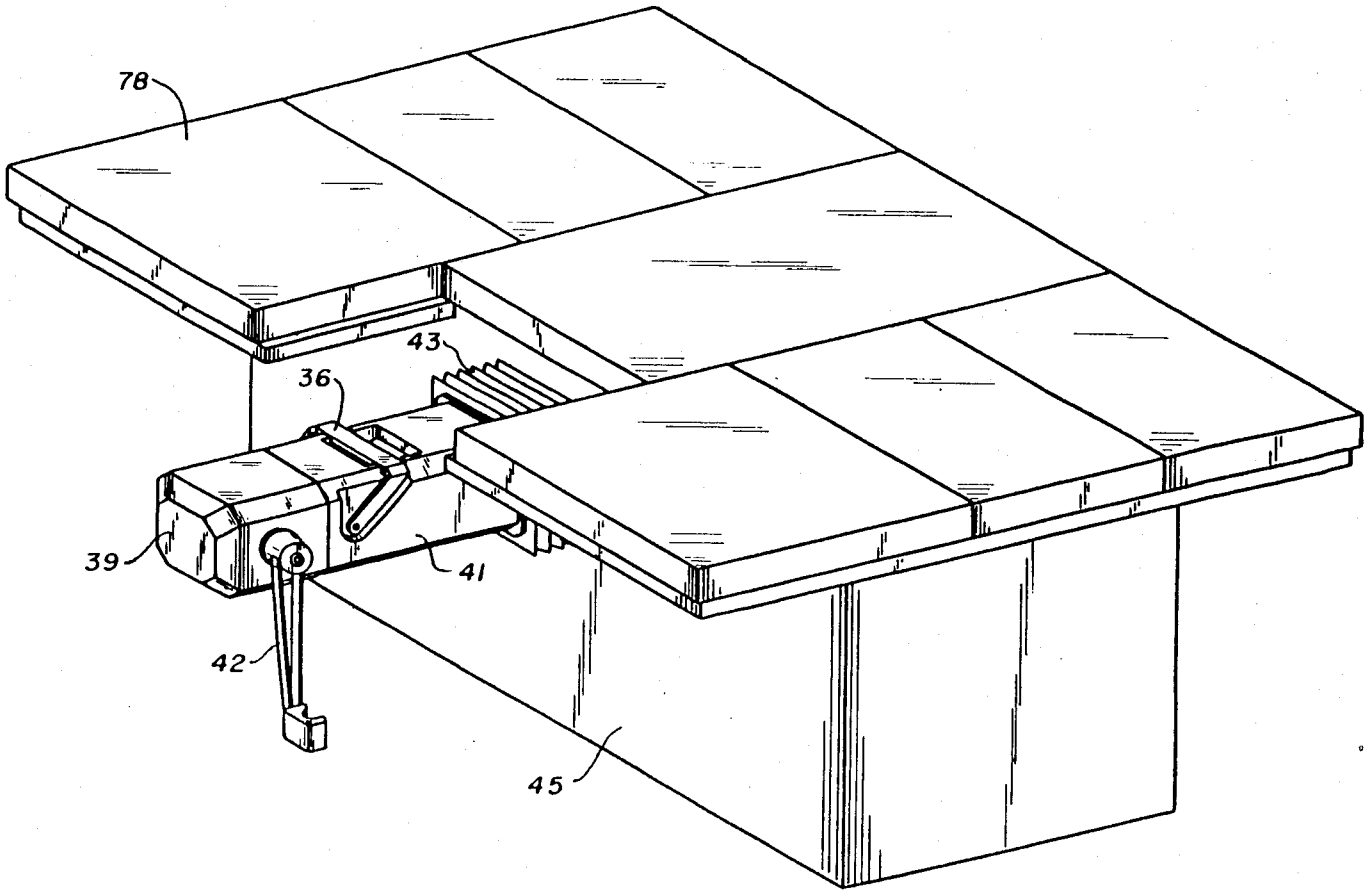
FIG. 3 is a perspective view of the exercising apparatus of FIG. 2 in completely assembled form.

FIG. 3 illustrates the completed exercising unit with gear housing shell 39 and clutch shell 41 enclosing the gear housing 38 and the clutch assembly 30, 31, and 34, respectively. A bellows 43 connects between the shell 41 and the main frame shell 45.

Figure 5:
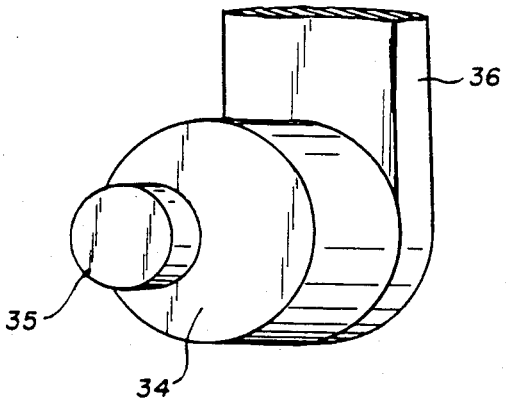
FIG. 5 is a perspective view of the cam.

The clutch housing as shown in more detail in FIGS. 4 and 5 consists of a cone 30 having a frusto-conical exterior surface connected to gear housing 38. The distal end of the cone has a circumferential groove 32 of rectangular cross-section. The center of the cone 30 has a cylindrical bore 49 to permit the passage therethrough of shaft 26 such that shaft 26 is free to rotate within bore 49. A cup 31 having an interior frustro-conical surface 37 which mates with that of cone 30 has a circular hole 47 therethrough which slidably receives large disk 34. At the end of large disk 34 (as shown in FIG. 5) there is affixed a small circular disk 35 whose center is offset with respect to that of large disk 34. Small disk 35 is slidably received within groove 32. A handle element 36 is affixed to large disk 34 and is rotatably coupled by means of screw 39 to the side of cup 31, diametrically opposite to that of hole 47. Thus, rotation of large disk 34 within hole 47 causes small disk 35 to move longitudinally of cup 31 thereby causing cone 30 to move longitudinally with respect to cup 31.

In operation, a user first operates pivoting motor 62 to cause rotation of the drive unit about pivot pins 70 until exercising arm 42 is moved to a desired elevation. In the event that a user wishes to exercise a side of his body opposite to that which arm 42 is positioned, handle 36 is pulled forward thereby causing large disk 34 to rotate within hole 47 to cup 31. Once small disk 35 has caused cone 30 to move out of contact with the frustro-conical surface 37 of cup 31, the user is then able to rotate gear housing 38 180° so as to position exercising arm 42 on the desired side of shaft 29. The gear housing 38 is then locked by lowering handle 36 and reversing the latter for operation. Main drive motor 18 is then switched on, causing driving sheave wheel 10 to rotate. Driven sheave wheel 12, in response to rotation of driving sheave wheel 10 and belt 14 rotates until sheave block 76 contacts load cell 74. Load cell 74 records on an external recorder (not shown) the amount of torque transmitted to sheave wheel 12 by means of friction between driving sheave wheel 10 and belt 14.

Next, tensioning motor 72 is operated in a desired direction so as to cause block 58 to move along threaded shaft 52 in a desired direction. Movement of block 58, which is rigidly affixed to mounting block 50 and gear box 20 causes sheave wheel 10 to move with respect to driven sheave wheel 12 and to adjust the tension in belt 14 until the torque recorded by load cell 74 reaches a desired magnitude. Then tensioning motor 72 is switched off. The exercising apparatus is then in a position to be used.

It will be recognized that in use arm 42 will exert both a concentric and eccentric force during the complete range of movement of a particular exercise. Moreover, because there is only kinetic friction involved which does not vary significantly with the speed of rotation with which arm 42 is moved, the force applied to the user is substantially constant throughout the range of the exercise movement.

It will be observed that the sub-frame assembly consisting of sub-frame elements 46 and 71, sheave wheels 10 and 12, gear box 20, mounting block 50, etc. can be applied to an exercise apparatus of almost any desired type. For example, a sprocket might be affixed to shaft 26 and a chain interconnected between the sprocket and a different form of exercise device.

Other variations, modifications and departures lying within the spirit of the invention and scope as defined by the appended claims will be obvious to those skilled in the art.

I claim:

1. A drive unit for an exercising apparatus, having a frame, comprising:

(a) a sub-frame;

(b) a driving sheave wheel, rotatably mounted on said sub-frame;

(c) a driven sheave wheel, rotatably mounted on said sub-frame;

(d) motor means coupled to said driving sheave wheel for rotatably driving same;

(e) an endless frictional belt linking said driving and driven sheave wheels and slipping with respect to one of the latter during rotation of said driving sheave wheel;

(f) a slide way bar affixed to said sub-frame;

(g) a mounting block slidably coupled to said slide way bar for supporting said driving element and movable in a direction for adjusting friction force between said driving and driven elements;

(h) motor means affixed to said sub-frame and coupled to said mounting block and operable to reversibly move said block over said slide way bar;

(i) stop means mounted on said sub-frame for blocking said driven element from movement beyond a start position, whereby said driving element is continuously driven by said motor means through an exercise.

2. A drive unit as defined by claim 1, wherein said stop means includes sensing means to provide a control signal proportional to the force thereon applied by said driven sheave wheel.

3. A drive unit as defined by claim 1, including an exercising member, an exercising member coupling means removably coupled to said driven sheave wheel and to said exercising member and reversibly movable from the start position in response to an external user applied force.

4. A drive unit as defined by claim 3, wherein said exercising member coupling means includes an elongated shaft coupled to said driven sheave wheel, gear means coupling said exercising member to said shaft, a shaft housing enclosing said shaft and coupled to said sub-frame, a gear casing enclosing said gear means, a clutch assembly coupled to said shaft housing and to said gear casing and manually operable to release and lock said casing against rotation with respect to said shaft.

5. A drive unit as defined by claim 4, including a frame wherein said sub-frame is pivotally coupled to said frame, pivoting motor means coupled to said sub-frame and fixed with respect to said frame operable to reversibly pivot said sub-frame with respect to said frame so as to adjust the elevation of said exercising member.

6. A drive unit as defined by claim 5, wherein said pivoting motor means includes a motor pivotally mounted on a based fixed relative to said frame, a threaded rod coupled to said motor means and reversibly rotatably driven thereby, a block having a threaded receptacle registering with said threaded rod, said block pivotally coupled to said sub-frame such that upon rotation of said threaded rod, said block moves along said rod and thereby pivots said sub-frame with respect to said frame.

7. A drive unit as defined by claim 5, wherein said clutch assembly includes a cup having a wall with a frustro-conical inner surface, a round hole through the wall, said cup axially aligned with and mounted over said shaft, a cone with a frusto-conical outer surface mating with the frusto-conical inner surface of said cup, said cone having a circumferential groove of rectangular cross-section on its outer surface and affixed to said gear casing, a cam having a round large disk slidably matingly insertable into the hole in said cup wall and a small disk affixed to said large disk with the center of said small disk offset from that of the large disk and said small disk slidably insertable into the groove in said cone, and a handle connected to said large disk pivotal from a lock position in which said cone abuts the interior surface of said cup to a release position in which said small disk moves said cone away from contact with said cup and permits rotation of said gear casing about said shaft.

8. A drive unit as defined by claim 2, wherein a belt contacting surface of said driving sheave wheel has a low coefficient of friction with said belt and a belt contacting surface of said driving sheave wheel has a high coefficient of friction with said belt.

9. A drive unit as defined by claim 5, wherein said sub-frame is pivotally coupled to said frame by pivotal connections affixed to said shaft housing.

* * * * *